United States Patent [19]

Ross et al.

[11] 4,020,139

[45] Apr. 26, 1977

[54] PROCESS FOR MELT SPINNING A PLURALITY OF ECCENTRIC SHEATH-CORE FILAMENTS

[75] Inventors: Roger Allen Ross; Donald Rittler Strachan, both of Martinsville, Va.

[73] Assignee: E. I. Du Pont de Nemours and Company, Wilmington, Del.

[22] Filed: Apr. 1, 1976

[21] Appl. No.: 672,714

[52] U.S. Cl. ..... 264/171; 264/168

[51] Int. Cl.[2] ..... B29F 3/10; B32B 31/30

[58] Field of Search ..... 264/171, 168, 176 F, 264/103, DIG. 26; 425/131.5, 725, 114; 428/374; 156/167, 296; 57/140 R, 140 BY, 140 J, 157 R

[56] References Cited

UNITED STATES PATENTS

| | | | |
|---|---|---|---|
| 3,244,785 | 4/1966 | Hollandsworth, Jr. | 264/171 |
| 3,381,074 | 4/1968 | Bryan et al. | 264/168 |
| 3,538,544 | 11/1970 | Ullman | 425/131.5 |
| 3,558,760 | 1/1971 | Olson | 264/171 |
| 3,662,440 | 5/1972 | Hill et al. | 264/168 |
| 3,704,971 | 12/1972 | Baird et al. | 425/197 |
| 3,718,534 | 2/1973 | Okamoto et al. | 264/DIG. 26 |

*Primary Examiner*—Charles E. Van Horn
*Assistant Examiner*—Michael W. Ball

[57] ABSTRACT

The sticking between an array of melt spun eccentric bicomponent filaments converged together into yarn is avoided by selecting the filaments being converged so that the thin sheath regions of the filaments do not contact one another and conducting the convergence in two steps if the number of filaments required for the yarn is too great for convergence in one step while avoiding the aforesaid contact.

10 Claims, 7 Drawing Figures

PROCESS FOR MELT SPINNING A PLURALITY OF ECCENTRIC SHEATH-CORE FILAMENTS

BACKGROUND OF THE INVENTION

This invention is directed to a process of melt spinning eccentric bicomponent filaments.

Eccentric bicomponent filaments have the property of self-crimpability, by virtue of the differential between the shrinkage of the two components of the filament. This property is useful in textiles for making stretch fabrics such as hosiery. Preferably, one component is eccentrically disposed entirely within the other component, whereby the first-mentioned component is the core component and the other component is the sheath component, such a shown in FIG. 5 of U.S. Pat. No. 3,244,785. This surrounds the lower melting core component with the higher melting sheath component to prevent the filaments from sticking together when converged after melt spinning. Because of the eccentric disposition of the core within the sheath, the sheath has a cross section that varies from a thin region to a thick region relative to one another.

U.S. Pat. No. 3,244,785 discloses a process for making an eccentric sheath-core filament by first forming a concentric arrangement of a core of one molten polymeric component in a sheath of another molten polymeric component, and while this concentric arrangement is still in molten form, injecting additional molten sheath polymeric component along one side of the concentric arrangement to force the core polymeric component to an eccentric position within the sheath. A row of the eccentric bicomponent filaments is melt spun and gas quenched during convergence (bringing together) of the filaments into yarn, and then the yarn is wound into a package. Between convergence and windup, the filaments can be treated, such as with steam, for dimensional stabilization. The yarn is then cold drawn at least about 4X and then heated at as low tension as possible to precrimp the yarn, followed by stretching to temporarily suppress the crimp and then making a fabric out of the yarn. In the case of the special filament compositions disclosed in Segraves and Mulholland, U.S. Pat. application Ser. No. 581,158, filed May 27, 1975 (Belgian Pat. No. 831,930), the cold drawn yarn can be made into the fabric directly, i.e., without precrimping, and then the fabric can be heated to develop the crimp for the first time.

U.S. Pat. No. 3,535,844 discloses a spinneret assembly for melt spinning a pair of rows of the sheath-core eccentric filaments of the type disclosed in U.S. Pat. No. 3,244,785, to thereby increase melt spinning capacity without undesirable crowding of the filaments and without increasing spinneret size. This is done by alternating the direction of the passages for injecting the sheath polymer along the side of the concentric sheath-core arrangement. The resultant filaments are spun with the thin sheath regions oriented to face the quench gas flow in one row and to face the opposite direction in the other row.

U.S. Pat. No. 3,704,971 discloses a spinneret assembly which doubles the production capacity of the spinneret assembly of U.S. Pat. No. 3,535,844 by providing a second pair of rows of orifices for melt spinning the filaments, with the orientation of the thin sheath regions of the filaments in this second pair of rows being a repetition of the opposite facing arrangement of U.S. Pat. No. 3,535,844 in the first pair of rows. In the embodiment shown in the patent, the distance between the pairs of rows is greater than the distance between the rows in each pair.

The spinneret assembly of U.S. Pat. No. 3,704,971 has operated satisfactorily to produce 18 denier yarn composed of eight eccentric sheath-core filaments (5.85 dpf as spun) converged together in a single step from two orifices in each of the four rows of orifices. When the spinneret assembly was used to make 17-3 yarn (22.3 dpf as spun), by grouping two adjacent filaments from one row with another filament from the adjacent row of the same pair of rows, the filaments randomly stuck to one another in the yarn converged therefrom. These stuck together portions would not crimp adequately, and the resultant poorly crimped portions caused appearance defects in fabric made therefrom. This sticking problem was unpredictable in the sense that sometimes it occurred under a given set of operating conditions, e.g., melt (spinning) temperature, windup rate, quench air temperature and velocity, and convergence guide friction, all of which affect the condition of the filament at convergence into a bundle, and sometimes the sticking did not occur.

Summary of the Present Invention

The present invention involves the discovery that this sticking of filaments together occurs only when the thin sheath region of one filament comes into contact with the thin sheath region of another filament during convergence, despite the fact that the entire outer surface of each filament is of the same sheath polymer. This sticking occurs under the same operating conditions as when sticking does not occur upon contact between the thin sheath region of one filament with the thick sheath region of another filament or between two thick sheath regions. Consequently, the present invention involves the selection of filaments from an array of melt spun filaments for convergence into bundles in which contact betwen thin sheath regions during convergence does not occur.

More specifically, the process of the present invention arises in the process of melt spinning a plurality of filaments each having a core component eccentrically disposed within a sheath component, the eccentricity of the core component within the sheath component providing the sheath component with a cross section varying from a thin region to a thick region relative to one another, gas quenching said filaments and converging said filaments together into yarn, wherein the converged together filaments randomly stick together, the improvement comprising selecting the filaments to be converged into said yarn to avoid contact between the thin sheath regions of the filaments during convergence, the number of filaments required for said yarn being at least three and requiring the convergence into at least one bundle to avoid said contact, said one bundle being said yarn when the number of filaments therein is equal to the number required for said yarn, and when more than one bundle is formed by said convergence to obtain avoidance of said contact, converging the resultant bundles together into said yarn, whereby the thin sheath regions of the filaments in said yarn do not stick together.

The selection of the filaments and the number of bundles formed from the filaments for subsequent convergence into the yarn will depend on the number of filaments required for the yarn and on the thin sheath orientation of the filaments in the array of filaments being melt spun. For example, with proper selection of filaments from the array, a three filament yarn will require only one convergence step into the yarn. On the other hand, a seven filament yarn will require convergence first into bundles of the desired number of filaments in each, wherein thin-sheath to thin-sheath contact during convergence is avoided, followed by convergence of the bundles into the yarn. The solution to the problem provided by the present invention does not involve expensive reconstruction of equipment such as the quench chimney and does not require any sacrifice in production capacity. This solution also eliminates the sensitivity of filament-to-filament sticking to slight and sometimes undetected changes in the above described operating conditions. The sticking of melt spun filaments together is in essence a condition of overcrowding. The present invention alleviates this overcrowding without requiring an increase in spinneret size.

BRIEF DESCRIPTION OF THE DRAWINGS

The present invention will be described in greater detail hereinafter with reference to the accompanying drawings in which.

DETAILED DESCRIPTION OF THE INVENTION

Figure 1:
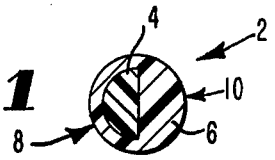
FIG. 1 shows in enlarged cross section an eccentric bicomponent filament which can be made by the process of the present invention.

FIG. 1 shows an eccentric bicomponent filament 2 in which a core 4 of one component of the filament is eccentrically disposed, e.g., in the D-shaped cross section shown, within a sheath 6 of the other component of the filament. Because of the eccentric disposition of the core 4 within the sheath 6, the cross section of the sheath varies from a thin region 8 to a thick region 10 relative to one another. The thin region 8 preferably has a thickness of only about 1% of the filament diameter.

Figure 2:
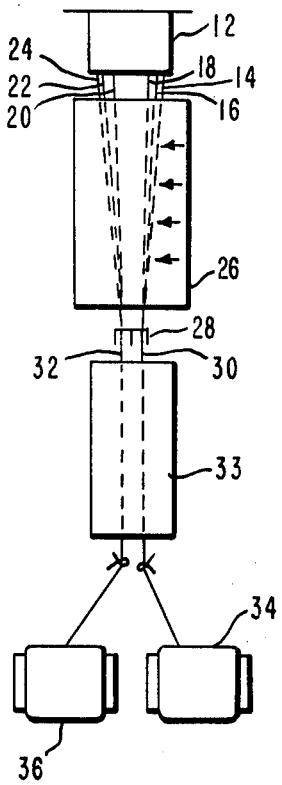
FIG. 2 shows in schematic side elevation an arrangement not within the present invention of melt spinning filaments like that of FIG. 1 and convergence of such filaments into yarn; for clarity in this Figure and in FIGS. 3 and 4, the convergence guide 28 and apparatus downstream thereof as shown in front elevation.
Figure 5:
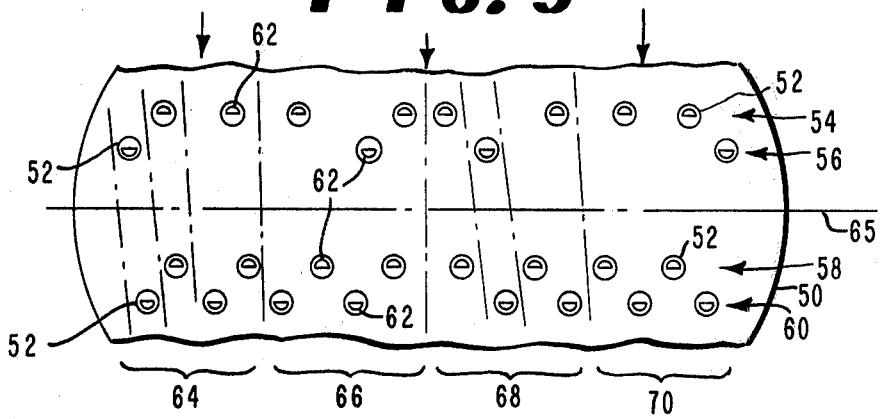
FIG. 5 shows in enlargement a plan view of a portion of the face of a spinneret plate and in cross section an array of eccentric bicomponent filaments being melt spun in accordance with the present invention.

In FIG. 2 a multiplicity of filaments each like that of FIG. 1 are melt spun and converged in a method which does not avoid filaments sticking together, such method therefore not being within the process of the present invention. More specifically, from a spinneret assembly 12 like that of U.S. Pat. No. 3,704,971 are melt spun four rows of eccentric bicomponent filaments, the first row represented for purposes of simplicity and clarity by filaments 14 and 16, the second row by filament 18, the third row by filament 20, and the fourth row by filaments 22 and 24. As in U.S. Pat. No. 3,704,971, the orientation of the eccentric core and thus the thin-sheath regions in the melt spun filaments is as follows: first and third row, facing the quench gas flow; second and fourth row, facing away from the quench gas flow. This orientation is the same as shown in FIG. 5. The first and second and the third and fourth rows form two pairs of rows of orifices and filaments spun therefrom, with the distance between these two pairs of rows being greater than the distance between the rows in each pair.

The filaments pass through a quench chimney 26 where they are converged, cooled and solidified from the molten condition to nonsticky state by cool gas, which is usually air, flowing in the cross direction indicated by arrows in the drawing. While the filaments are depicted as straight lines passing through the quench chimney, the filaments are in fact undergoing some random lateral movement during convergence, due to such influences as velocity variations in the quench gas striking the filaments. During passage through the quench chimney 26, the six filaments shown are converged between the fingers of a convergence guide 28 to form two yarns 30 and 32. The yarns are passed through a steam chamber 33 for dimensional stabilization and are then wound onto their respective packages 34 and 36.

As shown in FIG. 2, yarn 30 is made from filaments 14, 16, and 18 which are melt spun from adjacent rows of orifices in the spinneret plate and yarn 32 is made from filaments 20, 22, and 24 which are also melt spun from adjacent rows of orifices. The filaments 22 and 24 are melt spun from adjacent orifices in the fourth row and the filaments 14 and 16 are melt spun from adjacent orifices in the first row of orifices. The filaments 20 and 18 are melt spun from orifices that lie between the aforementioned adjacent orifices, respectively. The result of this approach used to make the 17-3 yarn hereinbefore described has been unpredictable random sticking of filaments together when converged into their respective yarns, particularly when the as-spun denier of the filaments exceeded about 10 dpf. This sticking has occurred because filaments 14 and 16 of yarn 30 are adjacent in the same row and have the same thin-sheath region orientation, and during convergence, the resultant random lateral movement of the filaments leads to side-by-side contact of the thin sheath regions thereby causing sticking. The same has occurred for filaments 22 and 24 of yarn 32.

Figure 3:
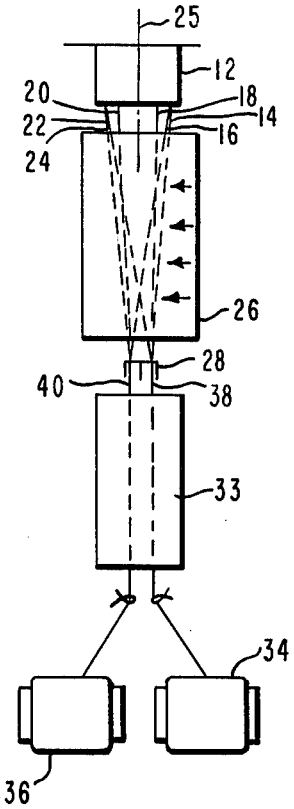
FIG. 3 shows in schematic side and front elevation as in FIG. 2 an embodiment of the present invention for melt spinning filaments like that of FIG. 1 and converging such filaments into yarn.

One embodiment of the present invention for avoiding this filament sticking result is shown in FIG. 3 wherein like elements are numbered the same as in FIG. 2. In this embodiment, yarn 38 is converged from filaments 14, 18, and 22 and yarn 40 is converged from filaments 16, 20, and 24. The filaments are melt spun from the same orifices as in FIG. 2. Interfilament sticking is avoided because in the grouping of filaments selected for convergence into yarns 38 and 40, there is no thin-sheath to thin-sheath contact between filaments, either face to face or side by side during convergence. For example, the thin sheath regions of filaments 14 and 18 face in opposite directions and the thin sheath region of filament 22 faces away from the thin sheath region of filament 18. The selection of filaments in this embodiment is of one per row. Since only three filaments are required for the yarn, it is possible to converge these filaments together in one step at convergence guide 28 to form the yarn.

An additional feature of filament selection in the embodiment of FIG. 2 is the selection of at least one filament from a row on each side of the centerline 25 of the spinneret assembly 12. This widens the angle of convergence of the filaments into their respective yarns, which maintains in filaments apart longer in the quench chimney giving them further opportunity for the thin sheath regions of the filaments to lose their stickiness before convergence together.

Figure 4:
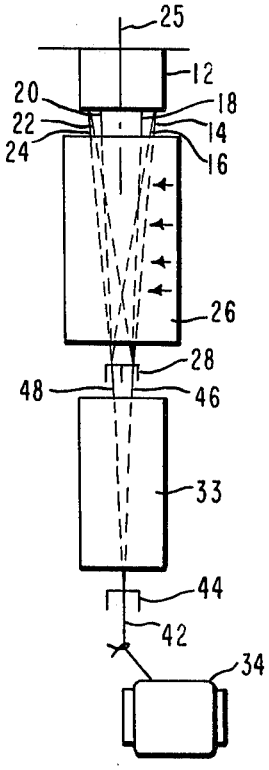
FIG. 4 shows in schematic side and front elevation as in FIG. 2 another embodiment of the present invention.

In another embodiment of the present invention shown in FIG. 4, wherein like elements are numbered the same as in FIGS. 2 and 3, a single yarn 42 is formed at convergence guide 44 at the exit end of the stem chamber 33 by converging two bundles 46 and 48 of yarns formed at convergence guide 28 in the same manner as yarns 38 and 40, respectively. This stepwise convergence of the melt spun filaments first into filament bundles prior to dimensional stabilization treatment and then the bundles into the desired yarn after completion of such treatment prevents the thin sheath regions of all six filaments from coming into contact with one another during initial convergence which would inevitably occur during single-step convergence of six filaments.

Another embodiment incorporating filament selection and stepwise convergence of the selected melt spun filaments into yarn in accordance with the present invention is shown in FIG. 5 depicting a portion of the face of spinneret plate 50 from which is melt spun a plurality of eccentric bicomponent filaments 52 in an array of four rows 54, 56, 58, and 60 corresponding to the four rows of the same total number of orifices in the spinneret assembly of U.S. Pat. No. 3,704,971 to make four seven-filament yarns. Since the same number of orifices is involved, this embodiment represents no loss of production capacity from that of the patent. In this embodiment, the difference from the patent spinneret assembly is the location of the orifices in the rows, which aids filament selection to avoid thin-sheath to thin-sheath contact. The eccentric core 62 is shown for each filament (cross-section shading of filaments 52 is omitted for clarity) to show the opposite orientation of the thin sheath region of each filament from row to row, which is the same orientation as produced by the spinneret assembly of U.S. Pat. No. 3,704,971. The thin sheath regions in row 54 face the quench gas flow coming from the direction indicated by the arrows in the drawing, which is from the back of the apparatus, and the thin sheath portions in row 56 face in the opposite direction. This orientation is repeated for rows 58 and 60 of filaments.

The filaments 52 melt spun from spinneret plate 50 are divided into four groups 64, 66, 68, and 70 of seven filaments each to form four seven-filament yarns. The selection of the filaments for each group runs across the centerline 65 of the plate 50 rather than in the direction of the rows or in groupings in closely spaced rows, e.g., rows 54 and 56. Each group of filaments is converged stepwise to yarn similar to the embodiment of FIG. 4 except that the convergence is first into three bundles of filaments indicated by the filaments encompassed within the phantom lines for groups 64 and 68 in FIG. 5, and then these three bundles of filaments are converged into their respective seven-filament yarn. As shown for group 64, the bundles are of two groups of two filaments each and one group of three filaments. This convergence pattern is repeated for group 70 and the convergence pattern of group 68 is repeated for group 66.

The selection of filaments for each bundle is such that no thin sheath regions face one another as can be seen from FIG. 5. The thin sheath regions either face in opposite directions or in the same direction, and no filaments from the same row are in the same bundle.

Figure 7:
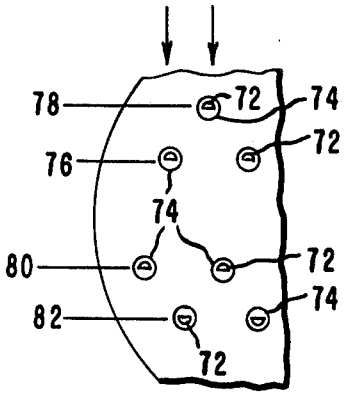
FIG. 7 shows in enlargement a plan view of a portion of the face of a spinneret plate and in cross section an array of eccentric bicomponent filaments being produced by the modified spinneret assembly of FIG. 6.

In another embodiment of the present invention, the selection step to avoid interfilament sticking is aided by changing the core orientation of the array of filaments. For example, as shown in FIG. 7, the cores 72 and thereby the thin sheath regions of the filaments 74 in row 76 of the filament face the same direction, i.e., towards the quench gas flow shown by the arrows, as in row 78, while the core orientation in rows 80 and 82 of filaments is the same as in rows 58 and 60 of FIG. 5. In this embodiment, it is possible to group four filaments into one bundle or yarn, one filament from each row without thin-sheath to thin-sheath contact to thereby prevent interfilament sticking.

Figure 6:
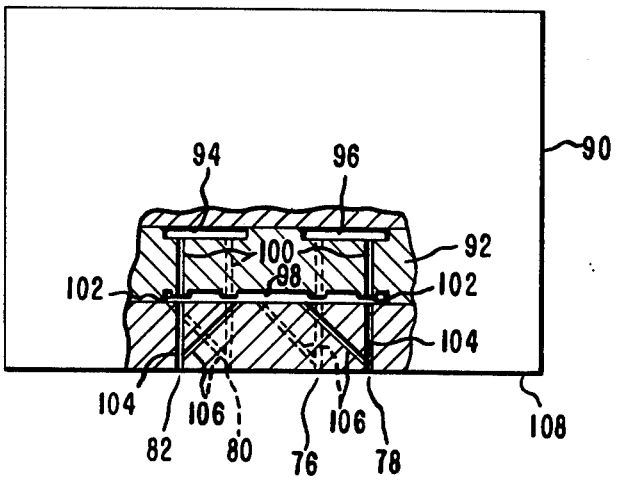
FIG. 6 shows in side elevation a spinneret assembly showing in partial cross section a modification thereto in accordance with the present invention.

The reorientation of the cores 72 in row 76 of filaments shown in FIG. 7 can be obtained by a modification of the spinneret assembly of U.S. Pat. No. 3,704,971 which modification is shown in FIG. 6. More specifically the spinneret assembly 90 includes a distribution plate 92 which has upper recesses 94 and 96 in communication with each other to form a flow channel for core component of the sheath-core filament. The distribution plate also has a lower recess 98 to form a flow channel for the sheath component of the filament. The recesses 94 and 96 and 98 can be supplied with their respective components in molten form in the same manner as shown in U.S. Pat. No. 3,704,971.

The core component from recesses 94 and 96 passes through core meter holes 100, each such hole representing a row thereof, the holes in one row being in staggered relationship with the holes in an adjacent row. The holes 100 terminate in cylindrical projections 102 in the recess 98. The core component exiting the holes 100 at projections 102 enter spinneret passages 104 in line therewith along with a concentric sheath of sheath component from recess 98.

For each spinneret passage, there is an angled passage 106 communicating between recess 98 and its respective spinneret passage 104 for injecting additional sheath component into the spinneret passage. This additional sheath component is combined in substantially side-by-side relation with the molten concentric sheath core arranged in the passage to be melt spun from the orifices of the spinneret passages at the face 108 of the spinneret as filaments having the cross section shown in FIG. 1.

The orifices of the four spinneret passages 104 correspond to the four rows of filaments of FIG. 7 as shown in FIG. 6. The alternating direction of the angled passages 106 for rows 80 and 82 is in accordance with U.S. Pat. No. 3,704,971. The angled passages 106 for rows 76 and 78 all extend in the same direction to obtain the core orientation for these rows of filaments shown in FIG. 7. In this embodiment, too, the filaments to be converged into each bundle are selected from rows on opposite sides of the centerline of the spinneret plate to provide at the same time a larger convergence angle to the converging filaments.

The foregoing discussed embodiments all involve a pattern of selecting filaments to be converged together into yarn or into bundles and then into yarn in accordance with the principle of avoiding contact between thin sheath regions of the filaments during convergence. The selection pattern depends on the orientation of the thin sheath regions, so as to avoid the selection of filaments in which the thin sheath regions are side-by-side, such as in adjacent orifices in any of the rows shown in FIGS. 5 and 7, or are face-to-face, for convergence in one step. As shown in the embodiments of FIG. 6 and 7, the thin sheath orientation can be changed to aid in the selection step. Whether or not stepwise convergence of filaments is required to make the yarn will depend on the number of filaments required to make the yarn. Generally, as many as four filaments can be converged in one step into one bundle by proper selection without thin-sheath to thin-sheath contact. A greater filament count, i.e., five filaments, for the yarn will require at least two bundles in the first converging step. As many as four and as few as one filament can be in each bundle but preferably each bundle is composed of 2 to 4 filaments for simplification purposes.

Generally, the melt spinning of eccentric bi-component filaments can be done in a multi-row array from a spinneret plate without requiring the process of the present invention when the as-spun denier per filament is less than about 10 measured on yarn prior to cold draw. Consequently, the present invention is most applicable when at least three of the melt spun filaments are to be converged into each yarn and when the as-spun denier per filament is at least about 10.

The principle of the present invention is applicable to all eccentric bicomponent filaments wherein the thin sheath regions remain sticky for a longer time than the remainder of the filament. Typically, the core is a low melting polymeric material and the sheath is a higher melting polymeric material. An example of such a sheath-core composition is disclosed in the aforementioned Segraves and Mulholland patent application particularly wherein the core is a copolymer of 25–45% by weight epsilon-caproamide units with 75–55% (to total 100%) by weight of hexamethylene dodecanedioamide units and the sheath polymer is polyhexamethylene dodecanedioamide. The process of the present invention is particularly applicable to making yarns of filaments of drawn denier greater than 3½ per filament, which yarns are especially useful in such applications as welt and leg yarn for hosiery. Typically such yarn will have a total drawn denier of at least 15 as a leg yarn and at least 35 as a welt yarn.

The presence or absence of sticking between filaments is evaluated by single end knitting the yarn from each yarn package into a tube about 16 cm long and having a relaxed diameter of about 15 cm. A succession of yarn packages can be evaluated by successively knitting the lengths of tubing, end-to-end and one length of tubing per package. The crimp in the fabric is developed by immersing the fabric in a boiling aqueous dye (hosiery brown color) bath. The fabric is dried in the relaxed condition and then visually inspected. Portions of the filaments that are stuck together for lengths of about 2.54 cm and longer do not crimp and are easily visible as a defect in the fabric. One such defect per length of tubing is counted as a rejection of the entire package, and the yarn is rated as a percent of packages rejected of the total packages tested. For commercial operation, a rejection rate of 0% for at least 50 packages of the yarn being evaluated is desired.

The process of the present invention is illustrated by the following example in which parts and percents are by weight unless otherwise indicated.

EXAMPLE

The following general procedure was used for spinning filaments from different spinneret orifice arrangements. The eccentric bicomponent filament had a cross section like that of FIG. 1 and had the following composition: The core was a copolymer of 30% by weight epsilon caproamide units and 70% by weight hexamethylene dodecanedioamide units and the sheath was 100% polyhexamethylene dodecanedioamide units, both prepared essentially by the procedure of Example 1 of the aforementioned Segraves and Mulholland patent application. The core copolymer had a relative viscosity of 44.2 ± 2.2 and the sheath polymer had a relative viscosity of 39.2 ± 2.1, the relative viscosities being measured on samples taken from the melt of each polymeric material just before entering the spinneret assembly. The filament was composed of 60% by weight core copolymer and 40% by weight sheath polymer. The melt temperature measured at the point where the relative viscosity samples were taken was 268° C for both polymeric materials. The windup speed was 421 yards per minute (385 m/min) and the as-spun denier per filament was about 27. The 60 inch (1.52 meter) quench chimney used cross air flow at 49° ± 1° F (9.5° ± 0.5° C). Before windup into packages the yarn was passed through a 75.6 inch (1.92 meter) long chamber containing saturated steam at atmospheric pressure for dimensional stabilization. The yarns were withdrawn from their packages and drawn at a draw ratio of 4.285X over an unheated draw pin located between the feed and draw rolls of a conventional draw twister to a denier per filament of 7.1 (7.9 dtex). The draw roll peripheral velocity was 790 yarns per minute (722.4 meters per minute). After drawing, the yarn was immediately passed through a 5.8 inch (14.7 cm) long tube through which hot air was jetted cocurrently at 0.7 ± 0.1 $ft^3$/min (19.8 ± 2.8 liters/min) to provide an exit-air temperature of 150° ± 3° C. At the point of air entry, the tube was 0.08 inch (0.20 cm) in diameter, increasing gradually to 0.20 inch (0.51 cm) at a distance of 2.8 inch (7.1 cm). There the tube diameter increased abruptly to 0.25 inch (0.63 cm) and remained constant for the last 3 inches (7.6 cm) of tube length. The yarn after exit from the tube passed in zig-zag fashion over three snub pins at a total contact angle of 390° ± 15°. The resultant annealed yarn was immediately packaged under tension, as described hereinafter. The ring and traveler windup following annealing was at a spindle speed of 7710 rpm to provide 0.271 turns per inch (0.107 turns per centimeter) of inserted twist. The resultant drawn yarns were then knitted into the tubes and crimped as hereinbefore described and these tubes were visually inspected for defects.

In a control experiment of this Example using the foregoing-described general procedure, the orifices of the spinneret had the four row arrangement of the spinneret assembly of U.S. Pat. No. 3,704,971. In a second experiment using the general procedure of this Example, the orifices of the same spinneret assembly were arranged in accordance with the embodiment of FIG. 5 of the present invention with the centerline distance between rows of each pair being about 0.6 cm and between each pair of rows being about 2.0 cm.

In the control experiment, the yarn was made by converging filaments selected from a pattern of two from one row, two from the adjacent row, two from a row on the opposite side of the spinneret centerline and one from the adjacent row thereto. These seven filaments were converged in one step at a convergence guide positioned between the quench chimney and steam chamber into seven-filament yarn. In the second experiment, the filaments were converged into bundles of two filaments, two filaments and three filaments selected in accordance with FIG. 5 prior to entering the steam chamber, and at the exit of the steam chamber, these bundles of filaments were converged into four seven-filament yarns. At least 50 packages of yarn were wound up and knitted into test tubing for each experiment.

The results of these experiments were as follows: For the control experiment, the percent of packages that were defective was 12½%. For the second experiment, none of the packages were defective.

Instead of packaging the yarn between the melt spinning and drawing operations, these operations can be coupled, in which case the dimensional stabilization following convergence could be omitted.

As many apparently widely different embodiments of this invention may be made without departing from the spirit and scope thereof, it is to be understood that this invention is not limited to the specific embodiments.

What is claimed is:

1. In a process of melt spinning a plurality of filaments each having a core component eccentrically disposed within a sheath component, the eccentricity of the core component within the sheath component providing the sheath component with a cross section varying from a thin region to a thick region relative to one another, gas quenching said filaments and converging said filaments together into yarn, wherein the converging filments stick together where a thin sheath region of one filament contacts a thin sheath region of another filament, but wherein sticking does not occur between contacting thin-thick or thick-thick regions of respective contacting filaments, the improvement comprising selecting the filaments to be converged into said yarn to avoid contact between the thin sheath regions of the filaments during convergence, the number of filaments required for said yarn being at least three and requiring the convergence into at least one bundle to avoid said contact, said one bundle being said yarn when the number of filaments therein is equal to the number required for said yarn, and when more than one bundle is formed by said convergence to obtain avoidance of said contact, converging the resultant bundles together into said yarn, whereby neither the thin sheath regions nor any other regions of the filaments in said yarn stick together.

2. In the process of claim 1 wherein the melt spinning of said filaments is from orifices arrayed in at least three rows and at least one of said bundles is converged from filaments selected from each said row.

3. In the process of claim 2 wherein four rows of said orifices are present.

4. In the process of claim 1, wherein at least five filaments are converged into at least two bundles.

5. In the process of claim 1 wherein one of said bundles comprise from 2 to 4 filaments.

6. In the process of claim 1 wherein the melt spinning of said filaments is from orifices arrayed in two pairs of rows of orifices, with the spacing between said pairs of rows being greater than between the rows of orifices in each pair, and said selecting is of at least one of said filaments from each pair of said two pairs of rows of orifices.

7. In the process of claim 6 wherein the improvement additionally comrises orienting the thin sheath regions of filaments spun from the orifices of one pair of said rows in the same direction and said selecting includes one filament from each row of said one pair of rows.

8. In the process of claim 1 wherein the asspun denier of each said filaments is at least about 10 denier per filament.

9. In the process of claim 1 wherein the filaments are subjected to dimensional stabilization treatment after said gas quenching and said convergence into more than one bundle is done prior to said treatment and said converging of the resultant bundles is done after completion of said treatment.

10. In the process of claim 1 wherein said sheath component is polyhexamethylene dodecanedioamide and said core component is a copolymer of 25–45% by weight epsilon-caproamide units and complementally 75–55% by weight hexamethylene dodecanedioamide units.

* * * * *